United States Patent [19]

Akano

[11] Patent Number: 4,959,649

[45] Date of Patent: Sep. 25, 1990

[54] CURRENT HOLDING CIRCUIT OF TWO-WIRE INSTRUMENT

[75] Inventor: Shinichi Akano, Tokyo, Japan

[73] Assignee: Yamatake-Honeywell Co., Ltd., Tokyo, Japan

[21] Appl. No.: 237,107

[22] Filed: Aug. 26, 1988

[30] Foreign Application Priority Data

Sep. 3, 1987 [JP] Japan ..... 62-133916[U]

[51] Int. Cl.[5] ..... G08C 19/02

[52] U.S. Cl. ..... 340/870.420; 307/353; 340/825.07; 340/825.39

[58] Field of Search ..... 340/870.42, 870.39, 340/870.04, 870.07, 870.16; 364/172; 307/353, 352; 328/151

[56] References Cited

U.S. PATENT DOCUMENTS

| | | | |
|---|---|---|---|
| Re. 30,597 | 5/1981 | Grindheim | 340/870.42 |
| 4,401,974 | 8/1983 | Jarrett et al. | 328/151 |
| 4,420,753 | 12/1983 | Meyer-Ebrecht | 340/870.42 |
| 4,651,034 | 3/1987 | Sato | 328/151 |
| 4,831,375 | 5/1989 | Kajiura | 340/870.39 |

FOREIGN PATENT DOCUMENTS

| | | | |
|---|---|---|---|
| 58-85649 | 5/1983 | Japan | 375/5 |

*Primary Examiner*—Ulysses Weldon
*Attorney, Agent, or Firm*—Townsend & Townsend

[57] ABSTRACT

A current holding circuit of a two-wire instrument which includes a transmitter and a receiving resistor, remotely located from the transmitter, for detecting a signal from the transmitter as a change in loop current, and to which a commuication device is connected, includes a current detecting unit, a sample-hold unit, and a current control unit. The current detecting unit includes a reference resistor for converting the loop current into a voltage and a first operational amplifier for receiving the voltage obtained by the reference resistor at the noninverting input terminal. The sample-hold unit holds an output from the current detecting unit. The current control unit supplies an output from the sample-hold unit to the inverting input terminal of the operational amplifier and controls the loop current on the basis of the output from the operational amplifier, thereby holding the loop current at a constant value.

3 Claims, 2 Drawing Sheets

CURRENT HOLDING CIRCUIT OF TWO-WIRE INSTRUMENT

BACKGROUND OF THE INVENTION

The present invention relates to a current holding circuit of a two-wire instrument to which a communication device is connected.

FIG. 3 is a circuit diagram showing a two-wire instrument comprising a transmitter (Tx) 1 located at a measurement site 2, and a power source 4 and a receiving resistor R as a receiver located in an instrument room 3 separated away from the measurement site 2. For example, the transmitter 1 detects a pressure difference such as a pressure change in a pipeline as a process variable and transmits detection data. The transmitter 1 transmits an analog current signal of 4 to 20 mA to the remote instrument room 3. This signal is received as a loop current change by the receiving resistor R. That is, the signal from the transmitter 1 is received by a voltage across the receiving resistor R.

A communication device 5 is generally of a portable type and is connected between two-wire loops (loop lines L1 - L2) at the site 2 as shown in FIG. 3, thereby communicating with the transmitter 1. In this case, communication is mainly a maintenance matter such as a parameter change or adjustment in the transmitter 1. Such a communication device is disclosed in Japanese Patent Laid-Open No. 58 (1983)-85649 (corresponding to USSN 317,083 filed on Nov. 2, 1981 entitled "Data Communication Apparatus and Method of Alternately Communicating Digital and Analog Data").

That is, a current is digitally flowed through the communication device 5 to change the voltage across the receiving resistor R, and this voltage change is detected by the transmitter 1 to perform communication. For this reason, while the communication device 5 is operated any current variation appears in the receiving resistor R as a received signal. Therefore, a loop current between the two-wire loops cannot be correctly held.

SUMMARY OF THE INVENTION

It is, therefore, a principal object of the present invention to provide a current holding circuit of a two-wire instrument to which a communication device is connected, which can correctly hold a loop current while the communication device is operated.

In order to achieve the above object of the present invention, there is provided a current holding circuit of a two-wire instrument which includes a transmitter and a receiving resistor, remotely located from the transmitter, for detecting a signal from the transmitter as a change in loop current, and to which a communication device is connected, comprising a current detecting means including a reference resistor for converting the loop current into a voltage and a first operational amplifier for receiving the voltage obtained by the reference resistor at a noninverting input terminal, a sample-hold means for holding an output from the current detecting means, and a current control means for supplying an output from the sample-hold means to an inverting input terminal of the operational amplifier and controlling the loop current on the basis of the output from the operational amplifier, thereby holding the loop current at a constant value.

Therefore, according to the present invention, the output from the sample-hold means is fed back to the inverting input terminal of the operational amplifier in the current detecting means, and the loop current is controlled on the basis of the output from the operational amplifier.

DETAILED DESCRIPTION OF THE PREFERRED EMBODIMENT

Figure 1:
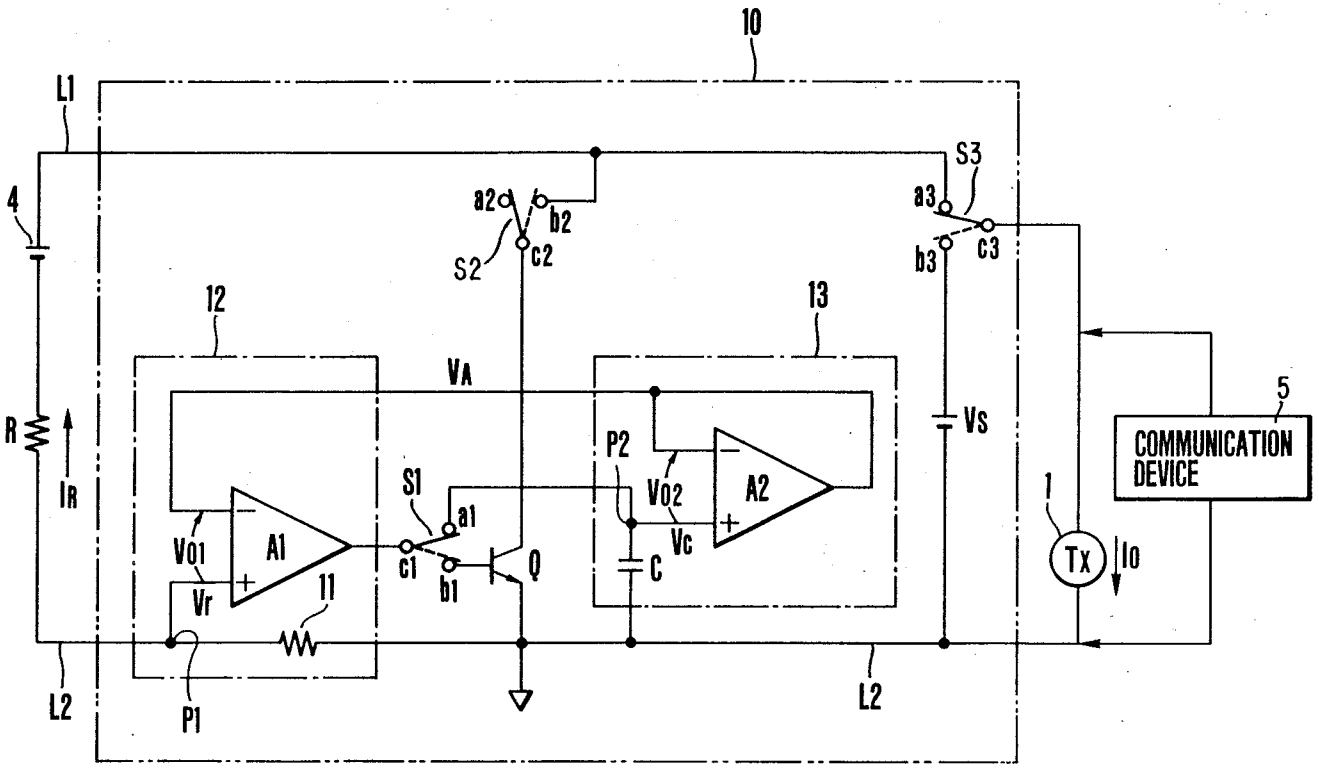
FIG. 1 is a circuit diagram showing an embodiment of a current holding circuit according to the present invention.
Figure 3:
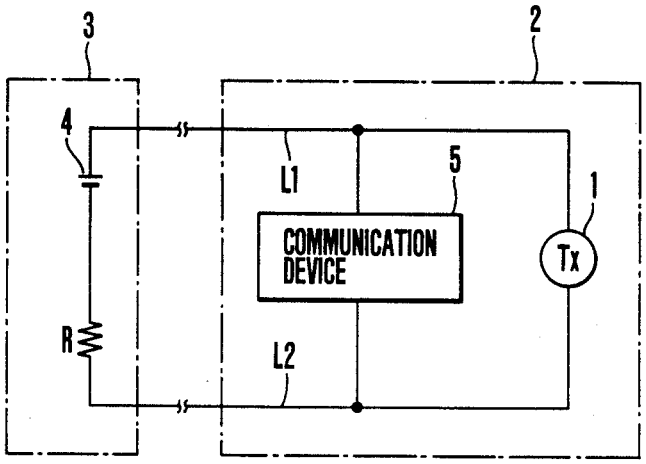
FIG. 3 (PRIOR ART)
FIG. 3 a circuit diagram showing an arrangement of a two-wire instrument and a connection state of a communication device.

A current holding circuit according to the present invention will be described in detail below. FIG. 1 is a circuit diagram in which an embodiment of the current holding circuit is applied to a two-wire instrument. In FIG. 1, the same reference numerals as in FIG. 3 denote the same parts, and a detailed description thereof will be omitted.

In this embodiment, a current holding circuit 10 comprises a current detector 12 consisting of an operational amplifier A1 and a reference resistor 11, a sample-hold circuit 13 consisting of an operational amplifier A2 and a capacitor C, an NPN transistor Q, an internal power source Vs, and switches S1, S2, and S3. That is, the reference resistor 11 is connected between the receiving resistor R of the loop line L2 of the two-wire instrument and the transmitter 1. A voltage Vr generated at a node Pl between the reference resistor 11 and the receiving resistor R is input to the noninverting input terminal of the operational amplifier Al. The output from the operational amplifier A1 is connected to a common terminal $c_1$ of the switch S1, and a normally closed contact terminal $a_1$ of the switch S1 is connected to the loop line L2 through the capacitor C. A voltage Vc generated at a node P2 between the capacitor C and the normally closed contact terminal $a_1$ of the switch S1 is input to the noninverting input terminal of the operational amplifier A2. An output from the operational amplifier A2 is fed back to its inverting input terminal and the inverting input terminal of the operational amplifier Al. When the switch S1 is switched to a normally open contact terminal $b_1$ in order to use a communication device 5, the output from the operational amplifier A1 is input to the base of a transistor Q1, the emitter and the collector of the transistor Q1 are connected to the loop line L2 and a common terminal $c_2$ of the switch S2, respectively. A normally open contact terminal $b_2$ of the switch S2 is connected to the loop line L1, the switch S3 is connected between the loop line L1 and the transmitter 1 through its normally closed contact terminal $a_3$ and a common terminal $c_3$, and the internal power source Vs is connected between a normally open contact terminal $b_3$ of the switch S3 and the loop line L2. Note that the switches S1, S2, and S3 may be of a manual type or interlocked type or may be automatically closed at a predetermined timing.

An operation of the current holding circuit 10 having the above arrangement will be described. As shown in FIG. 1, when the communication device 5 is connected in parallel with the transmitter 1 and no communication is performed between the communication device 5 and the transmitter 1, the common terminal of each of the switches S1 to S3 is connected to its normally closed contact terminal (as represented by solid lines in FIG. 1). Assuming that a resistance of the reference resistor 11 is r and a current flowing through the transmitter 1 is $I_0$, a voltage Vr input to the noninverting input terminal of the operational amplifier A1 is given by:

$$Vr = -I_0 . r \ldots \quad (1)$$

At this time, a loop current $I_R$ flowing through the receiving resistor R equals to the current $I_0$, $$I_R = I_0 \ldots \quad (2)$$

and a voltage $V_A$ fed back to the inverting terminal of the operational amplifier A1 through the operational amplifier A2 is given by:

$$V_A = Vr + V_{01} \ldots \quad (3)$$

where $V_{01}$ is an offset voltage of the operational amplifier A1.

That is, in order to establish the relation of $V_A = Vr + V_{01}$ in the operational amplifier A1, an output voltage from the operational amplifier A1 is adjusted, and the output voltage is sampled by the capacitor C in the sample-hold circuit 13 through the switch S1.

In order to perform communication from such a non-communication state when the communication device 5 is connected in parallel with the transmitter 1, connection modes of the switches S1, S2, and S3 are sequentially, and manually or automatically switched as indicated by broken lines in FIG. 1. That is, when the common terminal $c_1$ of the switch S1 is connected to its normally open contact terminal $b_1$, the common terminal $c_1$ is disconnected from the normally closed contact terminal $a_1$. Therefore, the output voltage from the operational amplifier A1 at this time is held in the capacitor C in the sample-hold circuit 13. That is, assuming that the current $I_0$ at this time is $I_0'$, the output voltage VA from the operational amplifier A2 is held as follows:

$$VA = -I_0' . r + V_{01} \ldots \quad (4)$$

The output voltage from the operational amplifier A1 is input to the base of the transistor Q through the common terminal $c_1$ and the normally open contact terminal $b_1$ of the switch S1. In this case, if the common terminal $c_2$ of the switch S2 is connected to its normally open contact terminal $b_2$ subsequently to the switch S1, the relation of $I_R = I_0$ remains the same. Therefore, since the emitter potential of the transistor Q is higher than its base input, the transistor Q is not turned on, and $I_R$ does not change.

When the common terminal $c_3$ of the switch S3 is connected to its normally open contact terminal $b_3$ subsequently to the switch S2, a power supply to the transmitter 1 from the power source 4 is disconnected, and a power source loop is formed between the internal power source Vs and the transmitter 1 so that the power source Vs supplies power to the transmitter 1. If communication to the transmitter 1 is performed in this state, the receiving resistor R is not adversely affected by a communication signal.

When the emitter potential drops upon switching of the switch S3, the transistor Q is turned on, and a potential generated at the node Pl between the reference resistor 11 and the receiving resistor R, i.e., the input voltage Vr to the noninverting input terminal of the operational amplifier A1 is controlled to be:

$$Vr = V_A - V_{01} \ldots \quad (5)$$

That is, when the equation (4) is substituted into the equation (5), Vr is controlled to be:

$$Vr = -I_0' \cdot r + V_{01} - V_{01} = -I_0' \cdot r \ldots \quad (6)$$

Therefore, the current $I_R$ flowing through the receiving resistor R is held at the current immediately before communication is started, i.e., at $I_0'$. In addition, as is apparent from the equation (6), the held current $I_0'$ is not adversely affected at all by the offset voltages $V_{01}$ and $V_{02}$ of the operational amplifiers A1 and A2, and therefore the loop current $I_R$ flowing through the receiving resistor R can be correctly held.

As described above, according to the present invention, influences of the offset voltages of the operational amplifiers can be eliminated. Therefore, an inexpensive operational amplifier (having a higher offset voltage) can be used, and a circuit arrangement can be simplified. As a result, a manufacturing cost can be largely reduced.

Figure 2:
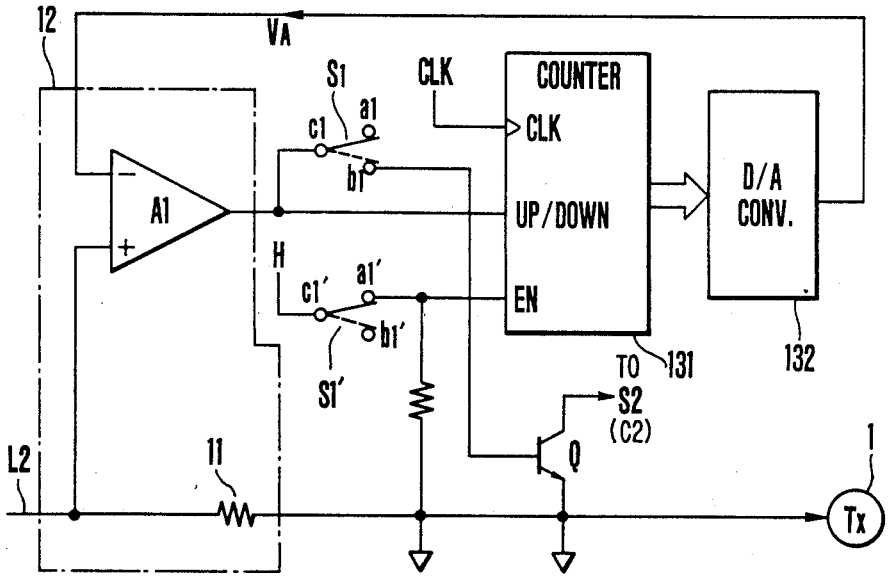
FIG. 2 is a circuit diagram showing another embodiment of a sample-hold circuit in the current holding circuit.

Note that in the above embodiment, the sample-hold circuit 13 comprises the capacitor C and the operational amplifier A2. However, an arrangement as shown in FIG. 2 using a counter 131 and a D/A converter 132 may be adopted. In this case, the counter 131 counts changes in an output from the operational amplifier A1 of the current detecting means 12. The counter 131 starts counting when a common terminal $c_1'$ of a switch S1' which is interlocked with or operated simultaneously with the switch S1 is disconnected from a normally closed contact terminal $a_1'$ and connected to a normally open contact terminal $b_1'$. *A count is converted into an analog value $V_A$* by the D/A converter 132 and supplied to the inverting input terminal of the operational amplifier A1 of the current detecting means 12.

As has been described above, according to the current holding circuit of the present invention, an output from a current detecting means comprising a reference resistor for converting a loop current into a voltage and an operational amplifier for receiving the voltage converted by the reference resistor at its noninverting input terminal is held by a sample-hold means. An output from the sample-hold means is supplied to the inverting input terminal of the operational amplifier, and the loop current is controlled on the basis of the output from the operational amplifier so that the loop current is held at a constant value. Therefore, the output from the sample-hold means is fed back to the inverting input terminal of the operational amplifier of the current detecting means, and the loop current is controlled on the basis of the output from the operational amplifier. As a result, the loop current can be accurately held without being adversely affected by the offset voltage of the operational amplifier at all.

What is claimed is:

1. In a two-wire instrument wherein a transmitter is coupled to a remotely located receiving resistor via a loop in order to detect a signal from said transmitter as a change in loop current, a current holding circuit for maintaining loop current at a substantially constant value when a communication device is coupled to the transmitter, said current holding circuit comprising:

means for generating a loop reference voltage, said means including a reference resistor for converting the loop current into a voltage and a first operational amplifier having a noninverting input for receiving the voltage obtained by said reference resistor, an inverting input for receiving a feedback signal, and an output for manifesting a voltage signal;

sample-hold means for hold the voltage signal output from said loop reference voltage means; and current control means for controlling the loop current through said receiving resistor on the basis of the output from said operational amplifier, thereby holding the loop current at a constant value, said current control means including an input terminal coupled to said sample-hold means and an output coupled to the inverting input of said operational amplifier for supplying said feedback signal thereto, said current control means further including a first loop forming means for forming a first loop including said receiving resistor, said reference resistor, and a first power source; and a second loop forming means for forming a second loop including said transmitter and a second power source, when the output of said first operational amplifier is disconnected from said sample-hold means, said first loop forming means being controlled by the output from said first operational amplifier, said first loop forming means including a transistor having a control input and an output, a first normally closed switch coupled between the output of said first operational amplifier and said sample-hold means, said first switch having a normally open terminal coupled to the control input of said transistor, and a second normally open switch coupled between the output of said transistor and said first power source, said first switch normally connecting the output of said first operational amplifier to an input side of said sample-hold means, and when said communication device is used, said first switch connecting the output of said first operational amplifier to the control input of said transistor, and said second switch being closed to connect said transistor output to said first power source to form said first loop.

2. A circuit according to claim 1, wherein said sample-hold means comprises a second operational amplifier having a noninverting input, an inverting input and an output, and a capacitor connected between the noninverting input of said second operational amplifier and said loop, the output and the inverting input of said second operational amplifier being mutually connected and also connected to the inverting input of said first operational amplifier.

3. A circuit according to claim 1, wherein said sample-hold means comprises a counter having an input connected to the output of said first operational amplifier and an output, and a converter coupled to the output of said counter for digital-to-analog converting an output from said counter, and means for enabling said counter to start counting when said communication device is connected.

* * * * *